US008830131B1

(12) United States Patent
Doane et al.

(10) Patent No.: US 8,830,131 B1
(45) Date of Patent: Sep. 9, 2014

(54) DUAL POLARIZATION ANTENNA WITH HIGH PORT ISOLATION

(75) Inventors: Jonathan P. Doane, Cedar Rapids, IA (US); Mark M. Mulbrook, Marion, IA (US); Brian J. Herting, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 907 days.

(21) Appl. No.: 12/707,361

(22) Filed: Feb. 17, 2010

(51) Int. Cl.
*H01Q 1/00* (2006.01)

(52) U.S. Cl.
USPC ..... 343/722; 343/797; 343/858

(58) Field of Classification Search
CPC ..... H01Q 5/00; H01Q 5/0034; H01Q 5/0003
USPC ..... 343/793, 855, 722, 797, 858
See application file for complete search history.

(56) References Cited

U.S. PATENT DOCUMENTS

| | | | | | |
|---|---|---|---|---|---|
| 4,555,521 | A * | 11/1985 | Engel et al. | ..... | 514/362 |
| 4,612,669 | A * | 9/1986 | Nossen | ..... | 455/123 |
| 4,635,069 | A * | 1/1987 | Waltonen | ..... | 343/799 |
| 4,940,989 | A * | 7/1990 | Austin | ..... | 343/749 |
| D343,703 | S * | 1/1994 | Bransky et al. | ..... | D30/127 |
| 5,552,796 | A * | 9/1996 | Diamond | ..... | 343/742 |
| 5,949,380 | A * | 9/1999 | Swank, II | ..... | 343/703 |
| 6,181,920 | B1 * | 1/2001 | Dent et al. | ..... | 455/101 |
| 6,208,302 | B1 * | 3/2001 | Jacob | ..... | 343/702 |
| 6,745,046 | B1 * | 6/2004 | Eckert et al. | ..... | 455/552.1 |
| 2001/0010662 | A1 * | 8/2001 | Saitou et al. | ..... | 368/281 |
| 2007/0103340 | A1 * | 5/2007 | Baranov et al. | ..... | 340/968 |
| 2007/0262854 | A1 * | 11/2007 | Colburn et al. | ..... | 340/438 |
| 2008/0122711 | A1 * | 5/2008 | Kimura et al. | ..... | 343/745 |
| 2008/0158083 | A1 * | 7/2008 | Apostolos | ..... | 343/791 |
| 2008/0174501 | A1 * | 7/2008 | Licul et al. | ..... | 343/703 |
| 2009/0038420 | A1 * | 2/2009 | Srikumar et al. | ..... | 73/865.9 |
| 2009/0195477 | A1 * | 8/2009 | Thiam et al. | ..... | 343/893 |
| 2009/0227260 | A1 * | 9/2009 | Anreddy et al. | ..... | 455/450 |
| 2009/0267849 | A1 * | 10/2009 | Yun et al. | ..... | 343/727 |
| 2009/0298451 | A1 * | 12/2009 | Malaga et al. | ..... | 455/129 |
| 2010/0033401 | A1 * | 2/2010 | Du | ..... | 343/893 |
| 2011/0263215 | A1 * | 10/2011 | Asplund et al. | ..... | 455/115.1 |

* cited by examiner

*Primary Examiner* — Dameon E Levi
*Assistant Examiner* — Collin Dawkins
(74) *Attorney, Agent, or Firm* — Donna P. Suchy; Daniel M. Barbieri

(57) ABSTRACT

The present invention is an integrated antenna assembly which allows for integration of a first radio system and a second radio system with the integrated antenna assembly. The integrated antenna assembly may include a coupler for providing sufficient isolation between the first radio system (ex.—a vertical polarization system) and the second radio system (ex.—a horizontal polarization system). The integrated antenna assembly may further include a common mode choke connected between a first antenna element and a second antenna element of the integrated antenna assembly. The coupler may produce a common mode based on signals received from the vertical polarization system and may also produce a differential mode based on signals received from the horizontal polarization system. The common mode choke may be configured for: preventing transmission of common mode currents from the first antenna element to the second antenna element; and being transparent to differential mode current flow.

20 Claims, 3 Drawing Sheets

DUAL POLARIZATION ANTENNA WITH HIGH PORT ISOLATION

FIELD OF THE INVENTION

The present invention relates to the field of antenna technology and particularly to a dual polarization antenna with high port isolation.

BACKGROUND OF THE INVENTION

Currently available communications systems require implementation of multiple, separate antenna installations in order to accommodate multiple radio systems. This may result in the currently available communications systems having excessive cost, being undesirably cumbersome and requiring a larger than desired degree of maintenance. Further, currently available communications systems have required physical distance between the separate antenna installations in order to provide sufficient isolation between the multiple radio systems.

Thus, it would be desirable to provide a device which obviates the problems associated with current antenna systems.

SUMMARY OF THE INVENTION

Accordingly, an embodiment of the present invention is directed to an integrated antenna assembly, including: a coupler, the coupler being configured for being connected to a first radio system and a second radio system, the first radio system being a vertical polarization system, the second radio system being a horizontal polarization system; a ground plane, the ground plane being configured for being connected to the coupler via a plurality of feed lines; a first antenna element, the first antenna element being configured for being connected to the ground plane, the first antenna element being a vertically-polarized antenna element; a common mode choke, the common mode choke being configured for being connected to the first antenna element; and a second antenna element, the second antenna element being configured for being connected to the common mode choke, the second antenna element being a horizontally-polarized antenna element, wherein the common mode choke is configured for preventing transmission of common mode currents from the first antenna element to the second antenna element, said common mode choke being further configured for allowing transmission of differential mode currents from the first antenna element to the second antenna element.

An additional embodiment of the present invention is directed to a method of operation of an integrated antenna assembly, said method including: receiving a first set of incoming signals, the first set of incoming signals being received via a first input port of a coupler of the integrated antenna assembly, the first set of incoming signals being provided by a vertical polarization radio system; providing a first set of coupler output signals, the first set of coupler output signals being transmitted from a first output port of the coupler to a plurality of feed lines of the integrated antenna assembly, the first set of coupler output signals being based upon the first set of incoming signals; generating common mode currents on a first antenna element of the integrated antenna assembly, the common mode currents being generated based upon the first set of coupler output signals; in response to the common mode currents being generated on the first antenna element, radiating electromagnetic energy in vertical polarization via the first antenna element; and preventing the common mode currents from being transmitted from the first antenna element to a second antenna element of the integrated antenna assembly, wherein said preventing is performed via a common mode choke of the integrated antenna assembly.

A further embodiment of the present invention is directed to a communications system, including: a first radio system, the first radio system being a vertical polarization system; a second radio system, the second radio system being a horizontal polarization system; and an integrated antenna assembly, the integrated antenna assembly being connected to the first radio system and the second radio system, the integrated antenna assembly comprising: a coupler, the coupler being connected to the first radio system via a first input port of the coupler, the coupler being connected to the second radio system via a second input port of the coupler; a ground plane, the ground plane being connected to the coupler via a plurality of feed lines; a first antenna element, the first antenna element being connected to the ground plane, the first antenna element being a vertically-polarized antenna element; a common mode choke, the common mode choke being connected to the first antenna element; and a second antenna element, the second antenna element being connected to the common mode choke, the second antenna element being a horizontally-polarized antenna element, wherein the common mode choke is configured for preventing transmission of common mode currents from the first antenna element to the second antenna element, said common mode choke being further configured for allowing transmission of differential mode currents from the first antenna element to the second antenna element.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
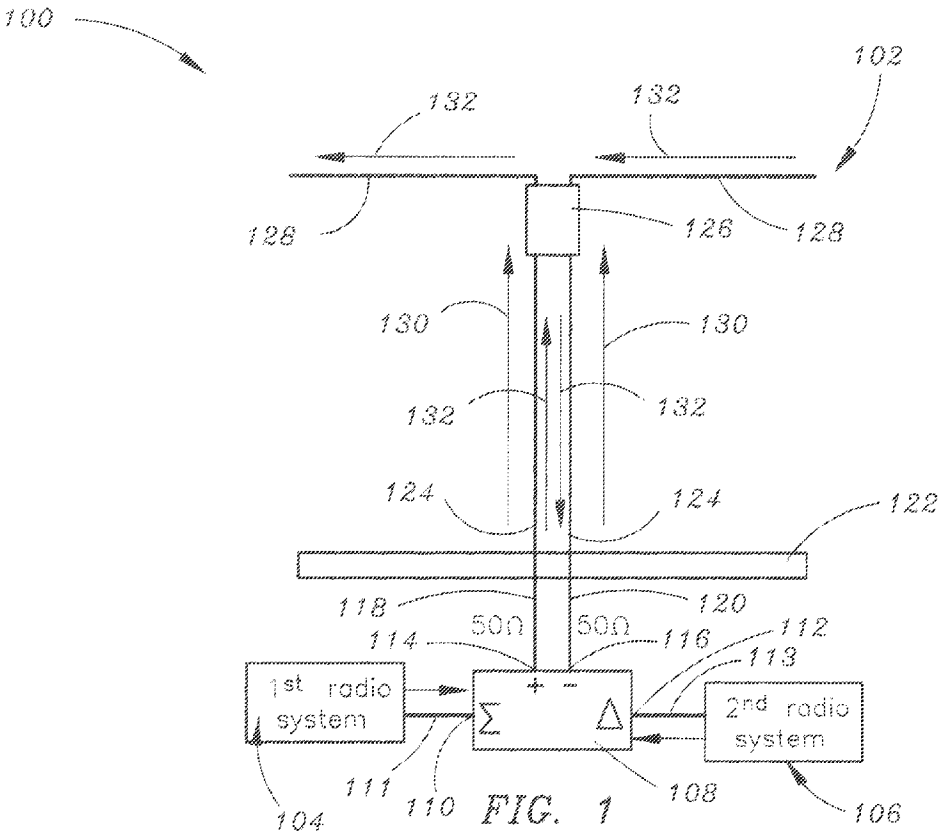
FIG. 1 is a block diagram schematic illustrating a communications system including an integrated antenna assembly (ex.—a dual polarization antenna) having high port isolation, said integrated antenna assembly being connected to multiple independently-functioning radio systems in accordance with an exemplary embodiment of the present invention.

Referring to FIG. 1, a communications system in accordance with an exemplary embodiment of the present invention is shown. In a current embodiment of the present invention, the communications system 100 may include an integrated antenna assembly 102. The communications system 100 may further include a plurality of radio systems, such as a first radio system 104 and a second radio system 106. In an exemplary embodiment of the present invention, the first radio system 104 and the second radio system 106 may be independently-functioning radio systems. In a further exemplary embodiment of the present invention, the first radio system 104 may be a vertical polarization system and the second radio system 106 may be a horizontal polarization system.

In exemplary embodiments of the present invention, the first radio system 104 may be a Very High Frequency (VHF) radio system (ex.—30 Megahertz (MHz) to 300 Megahertz (MHz) radio frequency range) and the second radio system 106 may be a VHF Omni-directional Range (VOR) radio system. In a further exemplary embodiment of the present invention, the first radio system 104 and/or second radio system 106 may be avionics systems.

In a current embodiment of the present invention, the integrated antenna assembly 102 may include a coupler 108. The coupler 108 may include a plurality of input ports, such as a first input port 110 and a second input port 112. The coupler 108 may be configured for being connected to the first radio system 104 via the first input port 110. For example, the first input port 110 of the coupler 108 may be connected to the first radio system 104 via a first input line 111. The coupler 108 may be further configured for being connected to the second radio system 106 via the second input port 112. For example, the second input port 112 of the coupler 108 may be connected to the second radio system 106 via a second input line 113. In exemplary embodiments of the present invention the coupler 108 may be a one-hundred-eighty degree hybrid coupler. In current embodiments of the present invention, the coupler 108 may be configured for providing at least forty decibels of isolation between the first radio system 104 and the second radio system 106. Such isolation may be advantageous in embodiments where the radio systems being implemented in the communications system 100 are systems which are similar in frequency and need to operate concurrently (ex.—simultaneously).

In further embodiments of the present invention, the integrated antenna assembly 102 may further include a ground plane 122. The ground plane 122 may be configured for being connected to the coupler 108 via a plurality of feed lines. For example, a first output port 114 of the coupler 108 may be connected to the ground plane 122 via a first feed line 118. Further, a second output port 116 of the coupler 108 may be connected to the ground plane 122 via a second feed line 120. For instance, the first feed line 118 and the second feed line 120 may each have an impedance of fifty ohms.

In exemplary embodiments of the present invention, the integrated antenna assembly 102 may further include a first antenna element 124. The first antenna element 124 may be configured for being connected to the ground plane 122. In further embodiments, the first antenna element 124 may be a vertically-polarized antenna element configured for radiating electromagnetic energy in vertical polarization (ex.—in a vertical polarization pattern). For example, the first antenna element 124 may be a twinlead transmission line. In exemplary embodiments of the present invention, the first antenna element 124 (ex.—the twinlead transmission line) may have an impedance of one hundred ohms.

In current embodiments of the present invention, the integrated antenna assembly 102 may further include a choke 126. For instance, the choke 126 may be an inductor designed to block a particular frequency in an electrical circuit, while passing signals of much lower frequency. In exemplary embodiments, the choke 126 may be an electronic choke 126, such as a common mode choke 126. The common mode choke 126 may be configured for preventing or reducing Electromagnetic Interference (EMI), Radio Frequency Interference (RFI) and/or common mode noise without significant reduction of a desired signal. The common mode choke 126 may be configured for being connected to the first antenna element 124. In further embodiments, the common mode choke 126 may be a high frequency choke and may be formed of a variety of materials. In an exemplary embodiment, the common mode choke 126 may have an iron powder or ferrite core. For instance, the common mode choke 126 may be a ferrite bead 126. The ferrite bead 126 may be a passive electric component which may be configured for suppressing high frequency noise in electronic circuits. For instance, the ferrite bead 126 may be configured for promoting the prevention of high frequency electrical noise (ex.—radio frequency interference) from exiting or entering electronic equipment, such as via power supply lines. The ferrite bead 126 may employ a mechanism of high dissipation of high frequency currents in the materials (ex—ferrite) of the ferrite bead 126 to operate as a high frequency noise suppression device. In exemplary embodiments, the ferrite bead 126 may include (ex.—may be at least partially composed of) ferrite, which may be a non-conductive ferromagnetic ceramic compound derived from iron oxides or oxides of other metals. For example, the ferrite bead 126 may be primarily composed of Iron (III) oxide. The ferrite bead 126 may be constructed in various shapes and may be configured in a variety of sizes. In an exemplary embodiment, the ferrite bead 126 may be cube-shaped and may have dimensions of one-half inch by one-half inch by one-half inch.

In further embodiments of the present invention, the integrated antenna assembly 102 may further include a second antenna element 128. The second antenna element 128 may be configured for being connected to the common mode choke 126. Further, the second antenna element 128 may be a horizontally-polarized antenna element configured for radiating electromagnetic energy in horizontal polarization (ex.—in a horizontal polarization pattern). For example, the second antenna element 128 may be a dipole, a Vee dipole, a loop antenna, or the like. In further embodiments of the present invention, the second antenna element 128 may be omni-directional. In still further embodiments, the first antenna element 124 may be oriented in a vertical direction between the ground plane 122 and the second antenna element 128 (as shown in FIG. 1).

In exemplary embodiments of the present invention, the common mode choke 126 may be configured for preventing transmission of common mode currents 130 from the first antenna element 124 to the second antenna element 128. In further embodiments, the common mode choke 126 is further configured for allowing transmission of differential mode currents 132 from the first antenna element 124 to the second antenna element 128. As mentioned above, the common mode choke 126 may be connected to (ex.—may be in physical contact with) the first antenna element 124 and the second element 128. For example, the common mode choke 126 may form a sleeve around (ex.—may at least partially enclose) portions of the first antenna element 124 and/or the second antenna element 128. In an alternative embodiment, portions of the first antenna element 124 and/or the second antenna element 128 may be wrapped at least partially around the common mode choke 126.

Figure 2A:
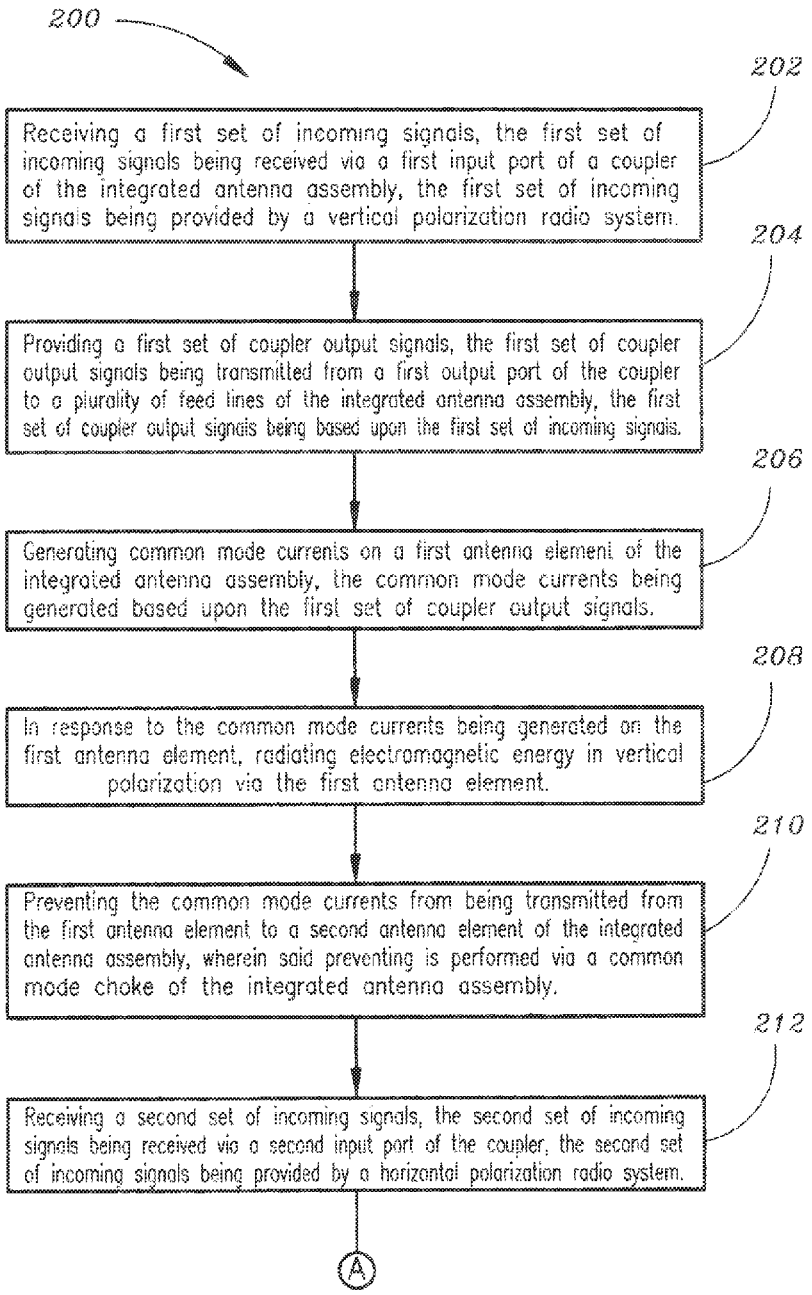
FIGS. 2A and 2B depict a flowchart illustrating a method of operation of an integrated assembly in accordance with a further exemplary embodiment of the present invention.
Figure 2B:
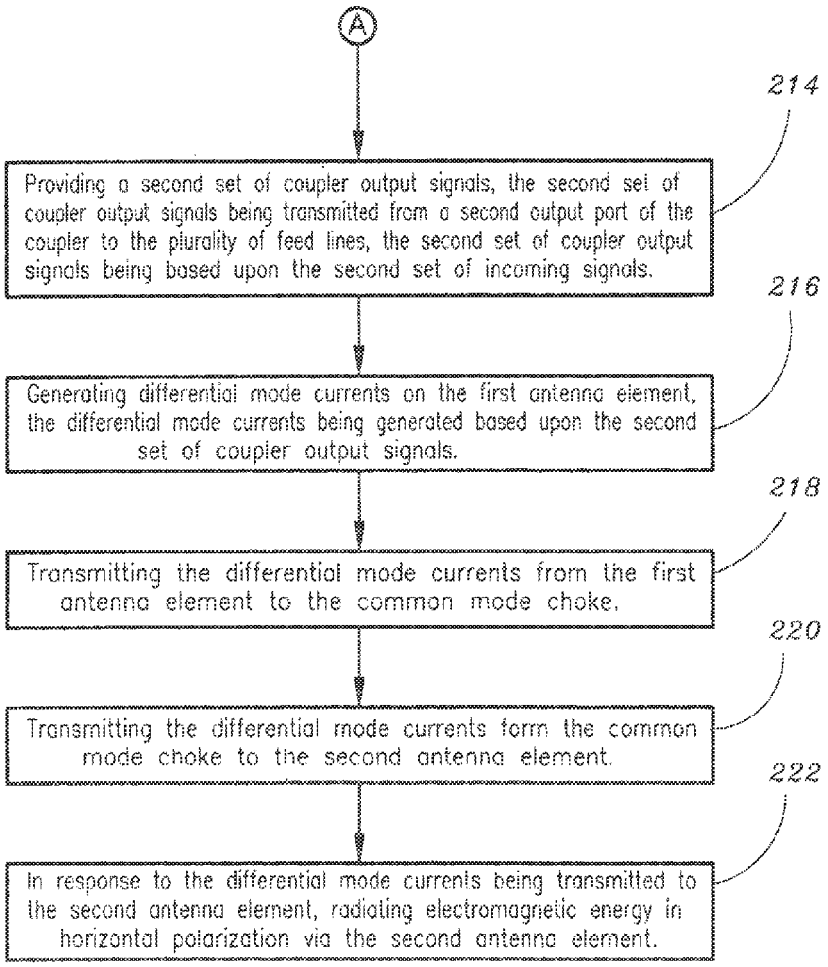

Referring generally to FIGS. 2A and 2B, a flowchart illustrating a method of operation of an integrated antenna assembly (ex.—such as the integrated antenna assembly 102 depicted in FIG. 1) in accordance with an exemplary embodiment of the present invention is shown. The method 200 may include the step of receiving a first set of incoming signals, the first set of incoming signals being received via a first input port of a coupler of the integrated antenna assembly, the first set of incoming signals being provided by a vertical polarization radio system 202. For example, the first set of incoming signals (exs.—radio system signals, electronic signals, etc.) may be provided by the first radio system 104 to the coupler 108 via the first input line 111. The method 200 may further include the step of providing a first set of coupler output signals, the first set of coupler output signals being transmitted from a first output port of the coupler to a plurality of feed lines of the integrated antenna assembly, the first set of coupler output signals being based upon the first set of incoming signals 204.

In exemplary embodiments of the present invention, the method 200 may further include the step of generating common mode currents on a first antenna element of the integrated antenna assembly, the common mode currents being generated based upon the first set of coupler output signals 206. For example, the first set of coupler output signals may be configured for exciting the feed lines (118, 120) in phase and causing the common mode currents 130 to be created on the first antenna element 124 (ex.—on the twinlead transmission line 124). In further embodiments, the method 200 may further include the step of, in response to the common mode currents being generated on the first antenna element, radiating electromagnetic energy in vertical polarization via the first antenna element 208.

In current embodiments of the present invention, the method 200 may further include the step of preventing the common mode currents from being transmitted from the first antenna element to a second antenna element of the integrated antenna assembly, wherein said preventing is performed via a common mode choke of the integrated antenna assembly 210. For example, the common mode choke (ex.—ferrite bead 126) may choke off or prevent common mode currents 130 from reaching/being transmitted to the second antenna element 128 from the first antenna element 124. Thus, as set forth in the above-described steps, the coupler 108 produces a common mode in which the first antenna element (ex.—twinlead transmission line 124) acts as a monopole, with the resonant frequency of the first antenna element 124 being determined by the vertical positioning or placement of the common mode choke 126 along the height of the twinlead transmission line 124.

The method 200 may further include the step of receiving a second set of incoming signals, the second set of incoming signals being received via a second input port of the coupler, the second set of incoming signals being provided by a horizontal polarization radio system 212. For example, the second set of incoming signals (exs.—radio system signals, electronic signals, etc.) may be provided by the second radio system 106 to the coupler 108 via the second input line 113.

In further embodiments of the present invention, the method 200 may further include the step of providing a second set of coupler output signals, the second set of coupler output signals being transmitted from a second output port of the coupler to the plurality of feed lines, the second set of coupler output signals being based upon the second set of incoming signals 214. The method 200 may further include the step of generating differential mode currents on the first antenna element, the differential mode currents being generated based upon the second set of coupler output signals 216. For example, the second set of coupler output signals may be configured for exciting the feed lines (118, 120) out-of-phase and causing the differential mode currents 132 to be created on the first antenna element 124 (ex.—on the twinlead transmission line 124).

The method 200 may further include the step of transmitting the differential mode currents from the first antenna element to the common mode choke 218. In exemplary embodiments of the present invention, the method 200 may further include the step of transmitting the differential mode currents from the common mode choke to the second antenna element 220. For example, the common mode choke (ex.—ferrite bead 126) may be transparent to the differential mode currents 132, thereby allowing the differential mode currents 132 to be transmitted from (ex.—to flow from) the first antenna element 124, through the common mode choke 126, to the second antenna element 128 and also, to flow from second antenna element 128, through the common mode choke 126, to the first antenna element 124 (as shown in FIG. 1), such that said differential mode currents 132 may be unaffected. The method 200 may further include the step of, in response to the differential mode currents being transmitted to the second antenna element, radiating electromagnetic energy in horizontal polarization via the second antenna element 222. Thus, as set forth in the above-described steps, the coupler 108 may produce a differential mode in which the first antenna element 124 extends the feed lines (118, 120) to the second antenna element 128.

The communications system 100 of the present invention allows for multiple radio systems (104, 106) to be integrated with a single, integrated antenna assembly 102, which may promote reduced cost, weight, and maintenance for the system 100 compared to the currently available systems which require implementation of multiple, separate antenna installations to accommodate multiple radio systems. In exemplary embodiments of the present invention, isolation between the first radio system 104 and the second radio system 106 may be provided via the integrated antenna assembly 102, thereby allowing for simultaneous and/or concurrent transmit and receive on the radio systems (104, 106). For example, signal transmission via the first antenna element 124 and signal reception via the second antenna element 128 may occur concurrently. Further, signal reception via the first antenna element 124 and signal transmission via the second antenna element 128 may occur concurrently. Thus, the integrated antenna assembly 102 (and the system 100) may allow for signal transmit via a first polarization (ex.—vertical polarization, via the first antenna element 124) and signal reception via a second polarization (ex.—horizontal polarization, via the second antenna element 128) to occur concurrently with high isolation.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An integrated antenna assembly, comprising:

a coupler, the coupler being configured for being connected to a first radio system and a second radio system, the first radio system being a vertical polarization system, the second radio system being a horizontal polarization system;

a ground plane, the ground plane being configured for being connected to the coupler via a plurality of feed lines;

a first antenna element, the first antenna element being configured for being connected to the ground plane, the first antenna element being a vertically-polarized antenna element;

a common mode choke, the common mode choke being configured for being connected to the first antenna element; and a second antenna element, the second antenna element being configured for being connected to the common mode choke, the second antenna element being a horizontally-polarized antenna element, wherein the common mode choke is in physical contact with the first antenna element and the second antenna element, said common mode choke prevents transmission of common mode currents from the first antenna element to the second antenna element and allows transmission of differential mode currents from the first antenna element to the second antenna element.

2. An integrated antenna assembly as claimed in claim 1, wherein at least a portion of at least one of the first antenna element and the second antenna element is wrapped at least partially around the common mode choke.

3. An integrated antenna assembly as claimed in claim 1, wherein the first antenna element is a twinlead transmission line.

4. An integrated antenna assembly as claimed in claim 1, wherein the common mode choke is a cube-shaped ferrite bead that forms a sleeve around the first antenna element and the second antenna element.

5. An integrated antenna assembly as claimed in claim 1, wherein the second antenna element is one of: a dipole; a Vee dipole; and a loop antenna.

6. An integrated antenna assembly as claimed in claim 1, wherein the first radio system and the second radio system are independently-functioning radio systems.

7. An integrated antenna assembly as claimed in claim 1, wherein the coupler is configured for providing isolation between the first radio system and the second radio system to allow for signal transmission via the first antenna element and signal reception via the second antenna element to occur concurrently.

8. A method of operation of an integrated antenna assembly, said method comprising:

receiving a first set of incoming signals, the first set of incoming signals being received via a first input port of a coupler of the integrated antenna assembly, the first set of incoming signals being provided by a vertical polarization radio system;

providing a first set of coupler output signals, the first set of coupler output signals being transmitted from a first output port of the coupler to a plurality of feed lines of the integrated antenna assembly, the first set of coupler output signals being based upon the first set of incoming signals;

generating common mode currents on a first antenna element of the integrated antenna assembly, the common mode currents being generated based upon the first set of coupler output signals;

in response to the common mode currents being generated on the first antenna element, radiating electromagnetic energy in vertical polarization via the first antenna element; and preventing the common mode currents from being transmitted from the first antenna element to a second antenna element of the integrated antenna assembly, wherein said preventing is performed via a common mode choke that forms a sleeve around and is in physical contact with the first antenna element and the second antenna element of the integrated antenna assembly, said common mode choke being further configured for allowing transmission of differential mode currents from the first antenna element to the second antenna element.

9. A method as claimed in claim 8, further comprising:

receiving a second set of incoming signals, the second set of incoming signals being received via a second input port of the coupler, the second set of incoming signals being provided by a horizontal polarization radio system.

10. A method as claimed in claim 9, further comprising:

providing a second set of coupler output signals, the second set of coupler output signals being transmitted from a second output port of the coupler to the plurality of feed lines, the second set of coupler output signals being based upon the second set of incoming signals.

11. A method as claimed in claim 10, further comprising:

generating differential mode currents on the first antenna element, the differential mode currents being generated based upon the second set of coupler output signals.

12. A method as claimed in claim 11, further comprising:

transmitting the differential mode currents from the first antenna element to the common mode choke.

13. A method as claimed in claim 12, further comprising:

transmitting the differential mode currents from the common mode choke to the second antenna element.

14. A method as claimed in claim 13, further comprising:

in response to the differential mode currents being transmitted to the second antenna element, radiating electromagnetic energy in horizontal polarization via the second antenna element.

15. A communications system, comprising:

a first radio system, the first radio system being a vertical polarization system;

a second radio system, the second radio system being a horizontal polarization system; and an integrated antenna assembly, the integrated antenna assembly being connected to the first radio system and the second radio system, the integrated antenna assembly comprising:

a coupler, the coupler being connected to the first radio system via a first input port of the coupler, the coupler being connected to the second radio system via a second input port of the coupler;

a ground plane, the ground plane being connected to the coupler via a plurality of feed lines;

a first antenna element, the first antenna element being connected to the ground plane, the first antenna element being a vertically-polarized antenna element;

a common mode choke, the common mode choke being in physical contact with the first antenna element; and a second antenna element, the second antenna element being in physical contact with the common mode choke, the second antenna element being a horizontally-polarized antenna element, wherein the common mode choke forms a sleeve around the first antenna element and the second antenna element and prevents transmission of common mode currents from the first antenna element to the second antenna element and allows transmission of differential mode currents from the first antenna element to the second antenna element.

16. A communications system as claimed in claim 15, wherein the first radio system is a VHF radio system.

17. A communications system as claimed in claim 16, wherein the second radio system is a VOR radio system.

18. A communications system as claimed in claim 15, wherein at least a portion of at least one of the first antenna element and the second antenna element is wrapped at least partially around the common mode choke.

19. A communications system as claimed in claim 15, wherein the coupler is configured for providing at least forty decibels of isolation between the first radio system and the second radio system.

20. A communications system as claimed in claim 15, wherein the common mode choke is a cube-shaped ferrite bead.

* * * * *